United States Patent [19]

Nishimura et al.

[11] Patent Number: 5,049,354

[45] Date of Patent: Sep. 17, 1991

[54] LOW THERMAL EXPANSION CAST IRON

[75] Inventors: Takanobu Nishimura; Motoo Suzuki, both of Kanagawa, Japan

[73] Assignee: Kabushiki Kaisha Toshiba, Kawasaki, Japan

[21] Appl. No.: 426,595

[22] Filed: Oct. 25, 1989

[30] Foreign Application Priority Data

Nov. 2, 1988 [JP] Japan ..... 63-276045

[51] Int. Cl.[5] ..... C22C 37/00; C22C 38/56

[52] U.S. Cl. ..... 420/27; 420/93; 148/324

[58] Field of Search ..... 148/324; 420/10, 27, 420/95

[56] References Cited

FOREIGN PATENT DOCUMENTS 58-210149 12/1983 Japan ..... 420/27

60251254 12/1985 Japan ..... 420/95

*Primary Examiner*—Deborah Yee

*Attorney, Agent, or Firm*—Foley & Lardner

[57] ABSTRACT

This invention is directed to a cast iron having a graphite structure in an austenitic iron matrix and consisting essentially of, in weight %, at least about 1.0% and not more than about 3.5% of carbon, not more than about 1.0% of silicon, at least about 29% and not more than about 34% of nickel, at least about 4% and not more than about 8% of cobalt and the balance substantially all iron.

10 Claims, 4 Drawing Sheets

LOW THERMAL EXPANSION CAST IRON

BACKGROUND OF THE INVENTION

This invention relates to a low thermal expansion cast iron of the austenitic type, and in particular relates to a low thermal expansion cast iron that has extremely low thermal expansion, and whose castability, machinability, and vibration absorption capability are adequately high.

As is well known, cast iron is widely used as a basic industrial material. The reasons for this are that this material has good castability so that it can easily be formed into a wide variety of complex shapes; cutting and working are easy; and material costs and melting costs are comparatively low, so that articles can easily be manufactured even in small scale works.

Recently, however, many organic and inorganic materials other than metals, such as new plastics, have been developed. Functional materials making use of their respective properties are rapidly becoming widespread. In particular, with the development of the electronics industry, materials are being demanded that can provide high accuracy and superior function, for use in machine tools, measurement devices, forming molds, and other manufacturing machinery.

To meet the above demands, cast iron materials are also being developed that have lower thermal expansion coefficients, increased ability to absorb vibration, as well as resistance to heat and corrosion, in addition to the existing properties of cast iron. Examples are invar cast iron (36.5% Ni-Fe alloy), and Ni-resist D5 (ASTM A439 type D-5) cast iron, which is an improvement of this. The chemical constituents of typical examples of such cast irons are set out in Table 1 below.

Invar contains 34% to 37% of nickel in the iron (hereinbelow, the proportions of all constituents are expressed in terms of weight %). It has a low thermal expansion coefficient of about $1.5\times10^{-6}/°$ C. in the neighborhood of ordinary temperatures (0° to 200° C.). The mechanism of low expansion of this Invar alloy is based on a spontaneous volume magnetostriction effect called the "Invar effect".

Super-invar is prepared by alloying 4% to 6% of cobalt with the iron/nickel base. Its thermal expansion coefficient in the vicinity of ordinary temperatures is $0.5\times10^{-6}/°$ C., which is even lower than that of Invar. However, since the above-mentioned Invar and Super-invar both have low castability, machinability, and ability to absorb vibration, their practical applications are limited to a fairly narrow field.

The low thermal expansion cast irons indicated in rows 3, 4 and 5 of Table 1 have also been developed. For example, Ni-resist D-5 is obtained by alloying the same amount of nickel as in the case of Invar with a cast iron having a graphite structure. It is formed by alloying 34% to 36% of nickel with iron having practically the same amount of carbon, silicon, and manganese as ordinary ductile cast iron. It maintains the castability, machinability, and ability to withstand vibration which are the advantages of cast iron, and, in addition, provides resistance to heat and corrosion, as well as providing a low expansion coefficient, due to the "Invar effect".

A further example of a material of this type is Novinite cast iron. This was disclosed in Japanese Patent Publication No. Sho. 60-51547. In this alloy cast iron, castability, machinability, and low expansion are achieved by alloying the same amounts of nickel and cobalt as in the case of Super-invar with ordinary ductile cast iron.

However, the above-mentioned Ni-resist D-5 and Novinite cast iron do not have such a low expansion as Invar and Super-invar, due to the fact that they contain the same amount of carbon, silicon, and manganese as ordinary ductile cast iron. Specifically, according to the measurements made by the inventors of the present application, their respective thermal expansion coefficients have the large values of $5\times10^{-6}/°$ C. and $4\times10^{-6}/°$ C. in the range of temperature 0° or 200° C.

Thus, the above-mentioned cast iron alloys are unable to satisfactorily meet modern requirements for further reduction of thermal expansion coefficient. Materials of even lower thermal expansion coefficient are required for recent precision devices and precision metal molding materials for FRP.

In order to provide a material that could cope with the above demands, having a thermal expansion coefficient below the prior art value of $4\times10^{-6}/°$ C. and having castability, machinability, and ability to absorb vibration, the inventors of the present application have investigated the relationship between the content of various alloying elements and thermal expansion coefficient and mechanical properties, carrying out numerous experiments and statistical analyses. As a result, they discovered a novel low thermal expansion cast iron, which is the subject of their Japanese Patent Application No. Sho. 62-268249. (U.S. application Ser. No. 07/262,784, filed Oct. 26, 1988, now abandoned.)

This low thermal expansion cast iron has the composition indicated in the last row of Table 1. Specifically, in a cast iron having an austenitic iron matrix, use is made of cast iron whose constituents are at least: carbon more than 1.0% and less than 3.5%, silicon below 1.5%, nickel at least 32% and less than 39.5%, cobalt at least 1.0% and less than 4%, the total content of the above-mentioned nickel and cobalt being less than 41%. The inventors discovered for the first time that, by using this cast iron, a low thermal expansion material could be provided having:

(1) A low thermal expansion coefficient ($2\times10^{-6}/°$ C.), and (2) Excellent castability, machinability, ability to absorb vibration, and mechanical strength.

Specifically, as a result of a series of experiments of various types, the present inventors discovered that, when 1% to 4% of cobalt is added to cast iron containing 1% to 3.5% of carbon and 32% to 39.5% of nickel, and the silicon addition is set to a low level, below 1.5% and preferably below 1%, cast iron is obtained whose thermal expansion coefficient is extremely small, but which yet has good castability and workability. Worked articles of higher precision can be provided by the development of this low thermal expansion cast iron.

Due to increased equipment size and demands for higher precision, however, circumstances are frequently encountered in which the existing low thermal expansion cast iron is not completely adequate. For example, with recent advances in communications technology such as satellite broadcasting, the parabolic antennas used for the sending and receiving equipment have become very large, and these must be precision-worked to high accuracy. For example, for antenna reflectors, carbon fiber reinforced plastic (CFRP), which has high rigidity and corrosion resistance, is generally used. However, since the thermal expansion coefficient of this CFRP is very small (about $1.5\times10^{-6}$/° C.), in order to ensure high dimensional accuracy of the product even after forming, the metal mold for forming must be made of a material that has a thermal expansion coefficient of the same order. Consequently, a material is required whose thermal expansion is less than that of the existing metal mold materials, i.e., is at most $1.5\times10^{-6}$/° C., and which yet has excellent mechanical properties.

SUMMARY OF THE INVENTION

It is therefore an object of the present invention to provide an improved low thermal expansion cast iron composition.

Another object of the invention resides in the provision of an improved cast iron which has extremely low thermal expansion as well as high castability, machinability, and vibration absorption.

It is a particular object of the invention to provide a low thermal expansion cast iron for use as a CFRP forming metal mold material, which has a thermal expansion coefficient of about $1.5\times10^{-6}$/° C., and preferably less, and excellent castability and machinability.

In accomplishing the foregoing objects, there has been provided according to one aspect of the present invention a cast iron having a graphite structure in an austenitic iron matrix and consisting essentially of, in weight %, at least about 1.0% and not more than about 3.5% of carbon, not more than about 1.0% of silicon, at least about 29% and not more than about 34% of nickel, at least about 4% and not more than about 8% of cobalt, and the balance substantially all iron.

According to another aspect of the invention, there has been provided a mold element for forming a carbon fiber reinforced plastic antenna reflector, comprising a generally dish-shaped mold element made of a cast iron composition having a thermal expansion coefficient of about $1.5\times10^{-6}$/° C. (at 0°-200° C.) and a composition as defined above.

Further objects, features and advantages of the invention will become apparent from the detailed description of the preferred embodiments that follows.

DETAILED DESCRIPTION OF THE PREFERRED EMBODIMENTS

The inventors found out, by experimental analysis, the minimum constituent conditions under which graphite can crystallize out in the alloy structure in the casting process, in order to improve castability and machinability; and by discovering the optimum component conditions for obtaining low thermal expansion.

Specifically, the low thermal expansion cast iron according to this invention is characterized in that, by weight %, the carbon content is more than about 1.0% and not more than about 3.5%, preferably more than about 2.0% and not more than about 3.0%, the silicon content is less than about 1.0%, preferably less than about 0.5%, the nickel content is more than about 29% and less than about 34%, and the cobalt content is more than about 4% and less than about 8%. Preferably, in addition to the above constituents, the cast iron contains not more than about 1.0% manganese, preferably not more than about 0.5%, and not more than about 0.1% magnesium.

Preferably, the thermal expansion coefficient at 0°-200° C. for the cast iron compositions of the invention is not more than about $4\times10^{-6}$/° C., more preferably not more than about $3\times10^{-6}$/° C., even more preferably not more than about $2\times10^{-6}$/° C., and most preferably about $1.5\times10^{-6}$/° C. or less.

The above composition range was set on the basis of the following results, which were first obtained by various experiments and analysis performed by the inventors.

The first of these results was to find the relationship between the thermal expansion coefficient and the contents of the various elements. The relationship shown by Equations 1 and 2 below was thereby obtained.

$$\text{Thermal expansion coefficient } (\times 10^{-6}/°\text{C.}) = 14.905 + 0.1\,[\text{solid solution C content}]\,(\%) + 1.49 \times [\text{Si content}]\,(\%) - 0.32 \times [\text{Ni content}]\,(\%) - 0.70 \times [\text{Co content}]\,(\%) + 1.35 \times [\text{Mn content}]\,(\%) \quad (1)$$

$$\text{Thermal expansion coefficient } (\times 10^{-6}/°\text{C.}) = -2.14 + 1.75\,[\text{solid solution C content}]\,(\%) + 2.11 \times [\text{Si content}]\,(\%) + 0.14 \times [\text{Ni content}]\,(\%) + 0.28 \times [\text{Co content}]\,(\%) + 0.25 \times [\text{Mn content}]\,(\%) \quad (2)$$

Figure 1:
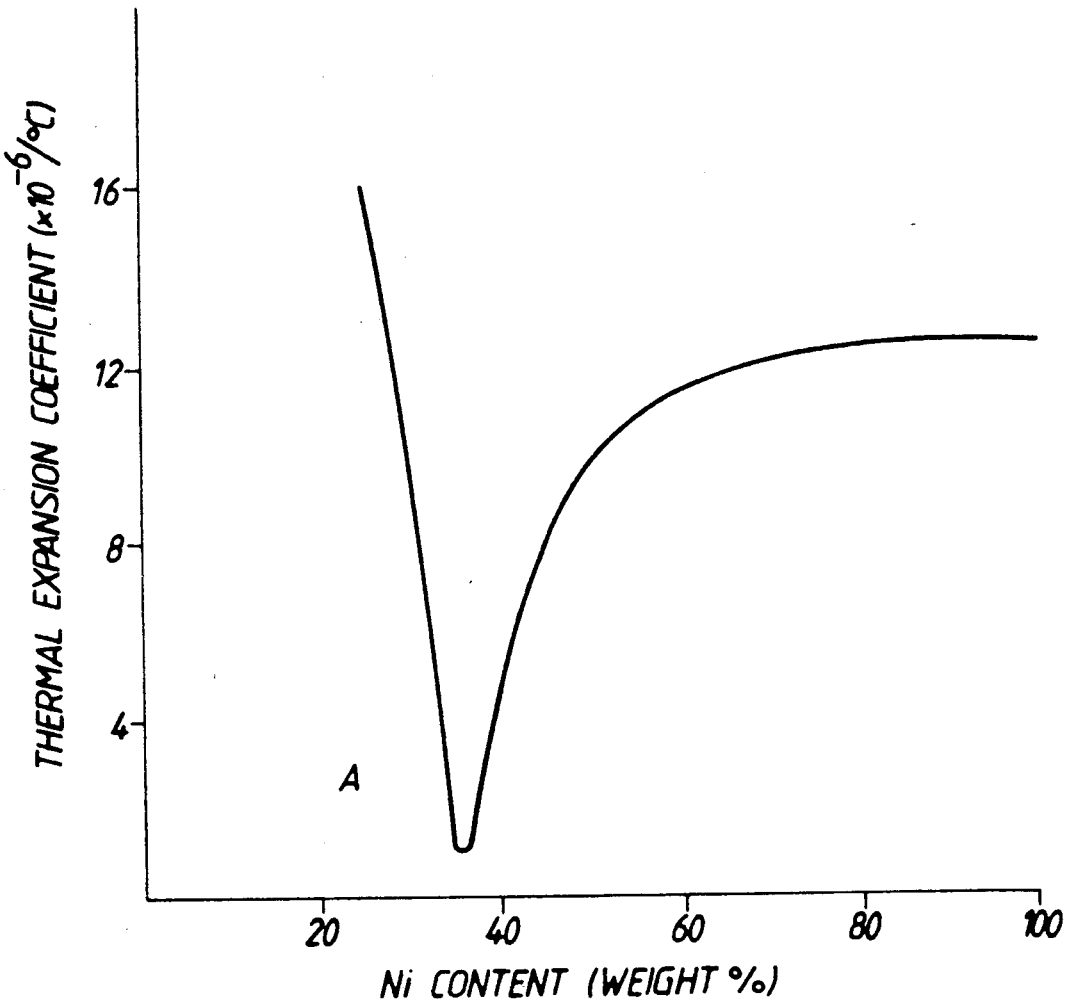
FIG. 1 is a graph showing the relationship between Ni and thermal expansion coefficient.

FIG. 1 shows the relationship between the thermal expansion coefficient of Fe-Ni alloy and the Ni content. As can be seen from this figure, if the Ni content is about 36%, the thermal expansion coefficient becomes very low. Equation (1) is therefore the relationship for the thermal expansion coefficient obtained as a result of analysis of the various alloy elements in the region where the Ni content is lower than the Ni content which gives the minimum of the thermal expansion coefficient In contrast, Equation (2) is the relationship for the thermal expansion coefficient obtained by analysis of the various alloy elements in the region where the Ni content is higher than the Ni content which gives the minimum of the thermal expansion coefficient. Comparing the various coefficients in Equation (1) and Equation (2), it can be seen that the coefficient of the Si content (%) is largest. That is, it can be seen that the silicon content has the largest effect on the thermal expansion characteristic, with a positive correlation. It can therefore be understood that a lower thermal expansion coefficient is obtained by lowering the silicon content to the absolute minimum.

Regarding the effect of the carbon content in an Fe-Ni alloy on the thermal expansion coefficient, previously, it was thought that the total carbon content had a considerable influence. However, according to the results of the inventors, it was discovered that it is not the total carbon content that has this influence, but only the carbon content in solid solution.

Figure 2:
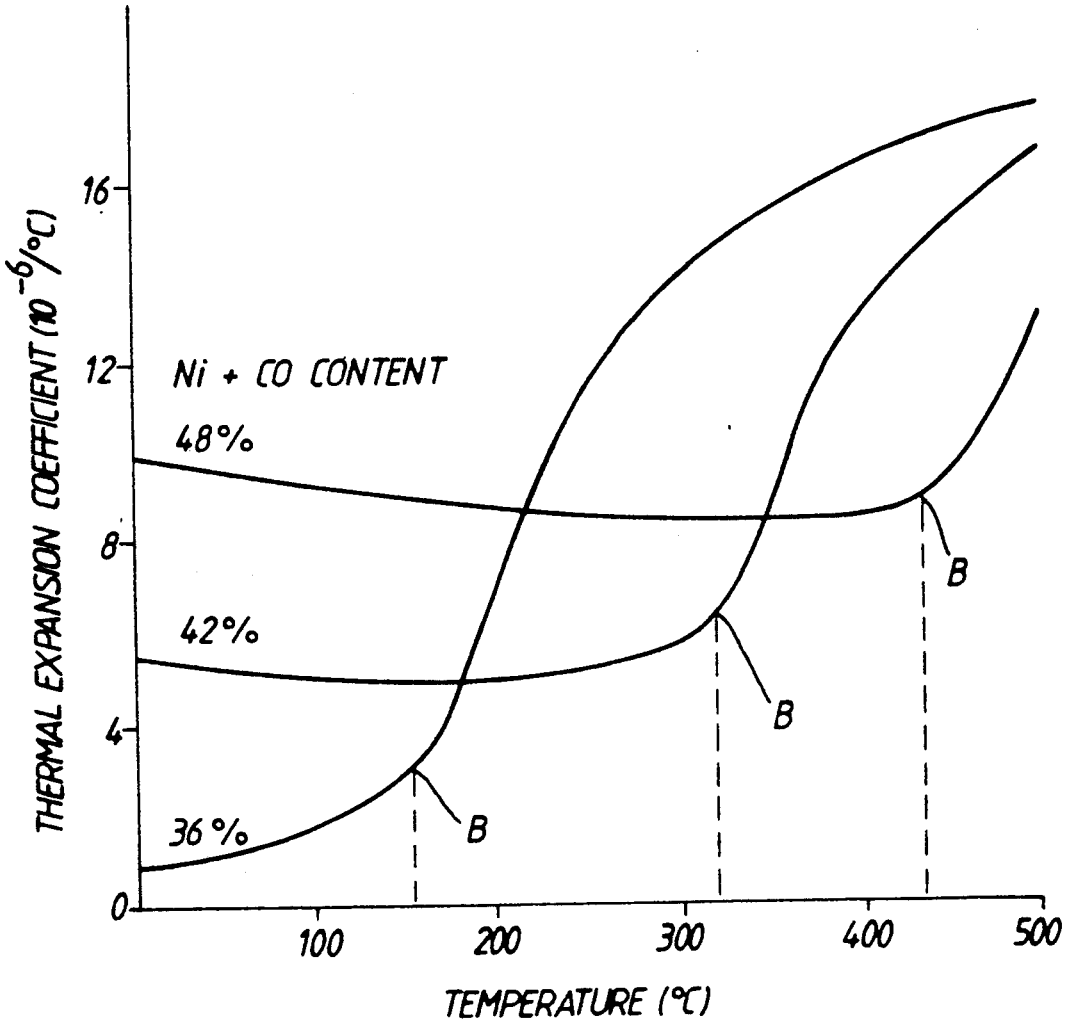
FIG. 2 is a graph showing the relationship between temperature and thermal expansion coefficient, taking the total content of Ni and Co in the cast iron as a parameter.

Next, as a second result, the relationship between temperature and thermal expansion coefficient when the total content of Ni and Co was varied is shown in FIG. 2. As shown in this figure, the respective temperature versus thermal expansion coefficient curves for each specific Ni+Co content show a point of inflection B, at which the temperature dependence of the thermal expansion coefficient rapidly increases. Also, as the Ni+Co content is increased, the temperature corresponding to this point of inflection B (hereinbelow termed the point of inflection temperature) shifts towards the high temperature side.

Thus, it can be seen from FIG. 2 that, when the Ni+Co content increases, the point of inflection temperature shifts to the high temperature side. As a result, the thermal expansion coefficient in the range of practically used temperatures from normal temperature up to 200° C. becomes high. In contrast, if the composition is set such that the point of inflection temperature is less than 325° C., preferably 200° C. to 250° C., in the practically used temperature range (0° to 200° C.), a low thermal expansion coefficient can be obtained.

By finding the relationship between this point of inflection temperature and the various element contents by experiment, the inventors obtained Equation (3) below.

$$\text{Point of inflection temperature (°C.)} = 22.5 \times [\text{Ni (\%)} + \text{Co (\%)}] - 22 \times \text{Mn (\%)} - 600.3 \quad (3)$$

From Equation (3), the discovery was obtained that it is possible to shift the point of inflection temperature further to the low temperature region by adding Mn.

Next, as the third result, it was ascertained that, by reducing the solid solution carbon content and carbide content, castability and machinability could be improved, and the ability to absorb vibration could be even further increased. That is, the carbon other than solid solution carbon is present in the form of graphite or carbides. Of these, the larger the amount of graphite crystallizing out, the smaller is the number of shrinkage holes during casting, thereby improving cutting workability, i.e., machinability; the ability to absorb vibration is also increased. On the other hand, when carbides are precipitated, this has the opposite effect, acting to produce microcavities, with an adverse effect on machinability also. It is therefore necessary to keep the solid solution C content and the amount of precipitated carbides as low as possible, and to keep the amount of graphite crystallizing out as high as possible.

As the fourth result, the relationships between solid solution carbon content and mechanical strength indicated by Equations (4) to (7) was obtained $$\text{Tensile strength (Kgf/mm}^2) = 19.6 + 93\,[\text{solid solution C content (\%)}] \quad (4)$$

$$\text{Yield strength (Kgf/mm}^2) = 4.8 + 135.5\,[\text{solid solution C content (\%)}] \quad (5)$$

$$\text{Young's modulus (Kgf/mm}^2) = 6982.5 + 19750\,[\text{solid solution C Content (\%)}] \quad (6)$$

-continued $$\text{Hardness (HB)} = 128.6 + 133\,[\text{solid solution C content (\%)}] \quad (7)$$

From Equations (1) and (2), in order to reduce the thermal expansion coefficient, it is desirable to decrease the solid solution C content. However, as can be seen from above Equations (4) to (7), in order to increase the mechanical strength, it is necessary to increase the solid solution C content. An optimum range is therefore determined in order to simultaneously satisfy low thermal expansion characteristics and good mechanical characteristics.

Figure 3:
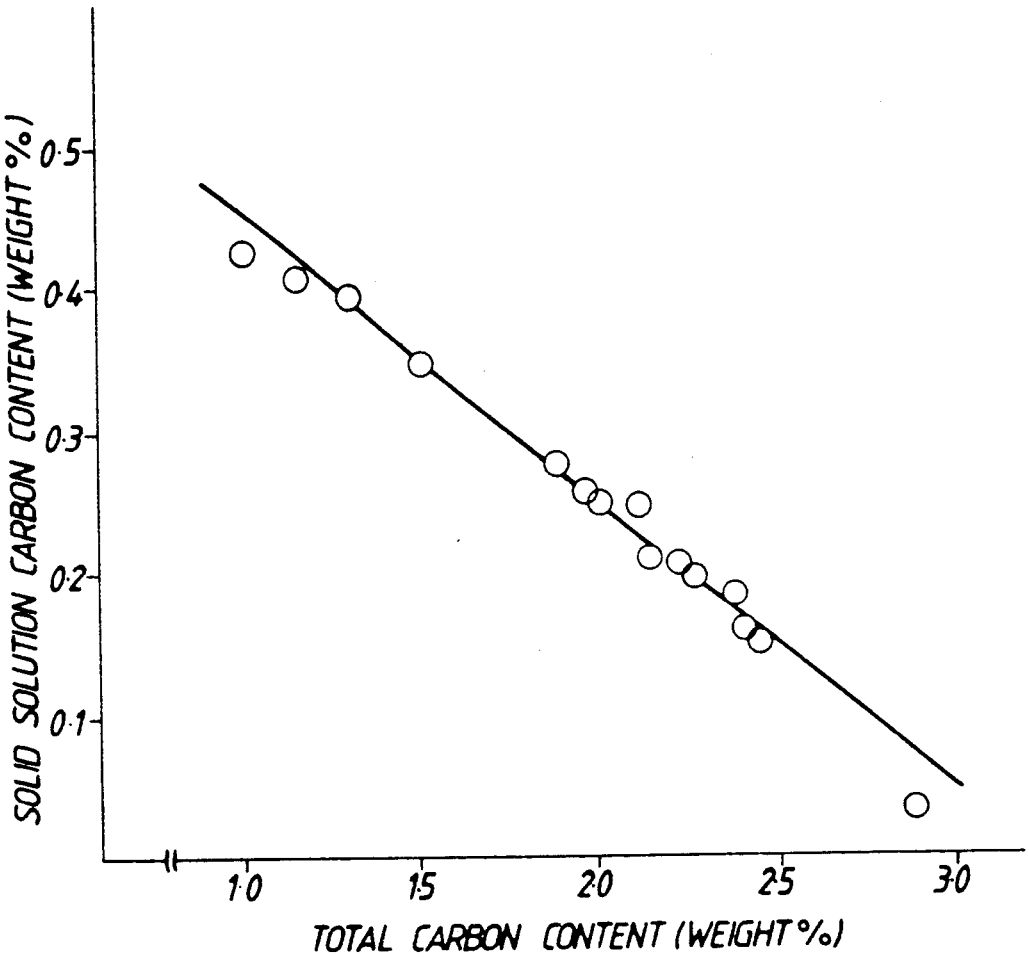
FIG. 3 is a graph showing the relationship between total carbon content and solid solution carbon content.

Finally, as the fifth result, the relationship between solid solution carbon content and total carbon content was found and is shown in FIG. 3. As can be seen from this figure, the solid solution carbon content falls with increase in the total carbon content The reason for this is believed to be that, when the total C content is high, the graphite amount crystallizing out in the initial solidification period increases, playing the role of providing sites for the solid solution C in the vicinity to form stable graphite. Consequently, when the solid solution C amount decreases at the time when solidification finishes, simultaneously the amount of C becoming carbide is diminished. The relationship between solid solution C content and total C content in FIG. 3 is shown by Equation (8).

$$[\text{Solid solution C content (\%)} = 0.65 - 0.20\,[\text{total C content (\%)} \quad (8)$$

Equations for the relationship between the total carbon content (total C content) and the various properties are derived by substituting this relationship of Equation (8) into Equations (1) to (7).

The composition of the low thermal expansion cast iron according to this invention was determined in accordance with the knowledge obtained from the above experimental results. A more detailed description will now be given concerning the content ranges of the various elements and the reasons for the restrictions.

First of all, the carbon content is set from about 1 to 3.5 weight %, preferably from about 1.5 to 3 weight %, and even more preferably from about 2.2 to 2.3 weight %. The carbon in the cast iron may be divided into carbon that has crystallized out as graphite and carbon in solid solution in the iron. In order to raise the castability, machinability, and low thermal expansion which constitute the object of this invention, the important point is to increase as far as possible the amount of carbon that is crystallized out as graphite, and to reduce as far as possible the amount of carbon in solid solution. Regarding the relationship between total carbon content and solid solution carbon content in the cast iron, as can be seen from FIG. 3 and Equation (8), raising the total carbon content would be in accordance with the object of the invention. However, the solid solution carbon content and amount of carbon crystallizing out as graphite have a large influence on the mechanical properties of the cast iron material. Specifically, the relationship between Young's modulus and total carbon content may be obtained, by substituting Equation (8) in Equation (6), as Equation (9) below.

$$\text{Young's modulus (Kgf/mm}^2) = 19820 - 3950\,[\text{total carbon content (\%)} \quad (9)$$

That is, it can be seen that the Young's modulus decreases when the total carbon content is raised.

The product to which the material of this invention is intended to be applied is a CFRP metal mold. When the material of this invention is used for this purpose, a Young's modulus of at least 9000 $Kgf/mm^2$ is needed. Consequently, from Equation (9), the required total carbon content cannot be more than about 2.8%. Considering the possibility of application of the material of this invention to structural members for which a Young's modulus only of the order of that of aluminum alloy is required, upper limit of the total carbon content can be extended as far as about 3.5%.

Also, the relationship between the thermal expansion coefficient and the various alloying elements may be derived from Equation (1) and Equation (8) as Equation (10) below.

$$\text{Thermal expansion coefficient } (\times 10^{-6}/°\text{C.}) = 14.97 - 0.02 \times [\text{total C content}]\ (\%) + 1.49 \times [\text{Si content}]\ (\%) - 0.32 \times [\text{Ni content}]\ (\%) - 0.70 \times [\text{Co content}]\ (\%) + 1.35 \times [\text{Mn content}]\ (\%) \quad (10)$$

It is clear from Equation (10) that the larger the total carbon content, the lower is the thermal expansion coefficient of the material. It is therefore desirable that the total carbon content should be set to a value that is as high as possible. However, if the total carbon content exceeds 3.5%, the solid solution carbon is decreased, causing a drop in mechanical strength and lowered castability.

On the other hand, the lower limit of the total carbon content may be determined from the relationship between the tendency for graphite to crystallize out and the thermal expansion coefficient. Specifically, the lower limit on the total carbon content for a sound graphite composition to be obtained is about 1%. Below about 1% insufficient graphite nuclei are produced during solidification, resulting in formation of carbides which greatly impairs machinability. For this reason, the total carbon content is set as at least about 1% and at most about 3.5%, preferably at least about 2.0% and at most about 3.0%.

Next, the silicon content is set to below about 1.0%. In the relationship shown in Equation (10), the coefficient of the silicon content is the largest, showing that the effect of the silicon content on the thermal expansion coefficient is large. Consequently, the lower the silicon content, the lower the thermal expansion coefficient which is obtained.

Silicon is an element that is necessary for promoting crystallizing out of graphite. However, unlike ordinary cast iron, the low thermal expansion cast iron of this invention contains about 30% of nickel, which constitutes a graphitization promotion element. It has therefore been found that the minimum content of silicon necessary to produce an inoculation effect can be provided by adding, for example, about 0.3% or more of silicon. Also, it has been found that, if graphite particles are used as inoculant, a satisfactory graphite composition can be obtained even if the silicon content is only a trace. However, in an ordinary casting site, iron-silicon is used as inoculant, and, in this case, a maximum added amount of about 0.5% is satisfactory.

Next, the content of manganese is set below about 1.0%. By adding manganese, the point of inflection B shown in FIG. 2 is shifted towards the low temperature side, which is effective in lowering the thermal expansion coefficient in the practically used temperature range of normal temperatures to 200° C. However, as in the case of silicon, if the manganese content exceeds about 1%, there is the opposite effect, in that the thermal expansion coefficient is increased. The added amount of manganese is therefore set to below about 1.0%, and preferably below about 0.5%.

Next, the Ni content is set from about 29% to 34%. The reason for setting it in this range is that if the Ni content is less than about 29% or more than about 34%, in either case, the thermal expansion coefficient is increased.

Also, the Co content is set in the range of from about 4% to 8%. If the Co content is less than about 4%, the thermal expansion coefficient is increased, but, if it exceeds about 8%, the point of inflection shown in FIG. 2 is shifted to the high temperature side, with the result that the thermal expansion coefficient in the practically used temperature range of from normal temperatures to 200° C. is increased.

It may be remarked that the appropriate ranges for the Ni content and Co content are affected by the carbon, silicon, and manganese contents. From the experimental results, the Ni content for which the thermal expansion coefficient is a minimum is given by Equation (11) below.

$$\text{Ni content } (\%) \text{ at thermal expansion minimum} = 35 - 0.29 \times [\text{Co content}]\ (\%) - 6.0\,[0.65 - 0.2 \text{ total C content}]\ (\%) + 0.57\,[\text{Mn content}]\ (\%) + 0.45\,[\text{Si content}]\ (\%) \quad (11)$$

If, for the reasons described above, the total carbon content is 1.5%, the silicon content 0%, and the manganese content 0%, the Ni content (%) at the thermal expansion minimum is given by Equation (12) below.

$$\text{Ni content at thermal expansion minimum } (\%) = 33 - 0.29 \times [\text{Co content}]\ (\%) \quad (12)$$

On the other hand, the total content of Ni and Co affects the temperature (inflection point temperature Θ) corresponding to the point of inflection B in the thermal expansion coefficient curve shown in FIG. 2. It also affects the value of the thermal expansion coefficient at this point of inflection B. In the range below point of inflection temperature Θ, the temperature variation of the coefficient of thermal expansion is small, but, in the range above the point of inflection temperature Θ, it rapidly increases.

Equation (13) below was obtained by finding experimentally the relationship between the point of inflection temperature Θ and total Ni and Co content.

$$\text{Point of inflection temperature } \Theta\ (°\text{C.}) = 22.5 \times [\text{Ni content } (\%) + \text{Co content } (\%)] - 600.7 \quad (13)$$

Assuming a CFRP metal mold that is to be used in the practical temperature range of from normal temperature to about 200° C. as the use to which this cast iron of the invention is to be applied, if the point of inflection temperature Θ is set at 200° C. to 250° C., the appropriate range for the total content of Ni and Co is given by Equation (14) below.

$$\text{Ni content (\%)} + \text{Co content (\%)} = 36 \text{ to } 38 \text{ (\%)} \quad (14)$$

From the relationships of Equation (14) and Equation (12), the optimum Ni content is calculated as from about 29% to 33%, and the optimum Co content as from about 4% to 7%. These contents are therefore set in this composition range.

Magnesium is an element that is necessary for the crystallizing out of graphite in spherical form. Its content is set as not more than about 0.1 weight %. If the magnesium content exceeds about 0.1%, this is undesirable because of the formation of carbides. It is therefore desirable that the magnesium content should be in the range of from about 0.04% to 0.1%.

SPECIFIC PREFERRED EMBODIMENTS

A description will now be given with reference to specific preferred embodiments of this invention, referring to the figures and tables.

EMBODIMENT 1

Figure 4A:
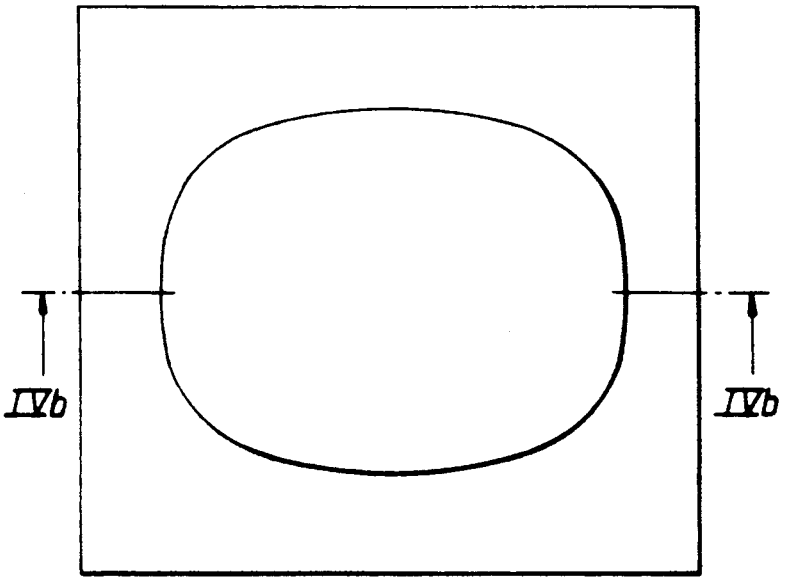
FIG. 4A is a plan view showing the shape of a mold for CFRP molding cast in accordance with an embodiment of this invention.
Figure 4B:
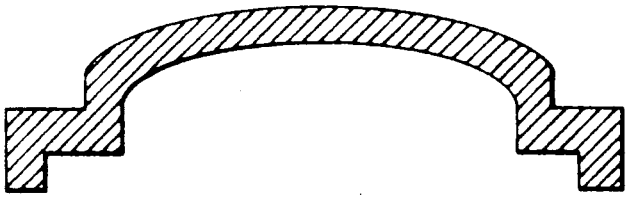
FIG. 4B is a cross-sectional view along the direction of the arrows IVB—IVB in FIG. 4A.

A metal mold for forming CFRP was cast as shown in FIGS. 4(*a*) and *b*). The metal mold was of height 70 cm, width 65 cm, thickness 6 cm, and weight 130 kg. For melting, a radio frequency electric furnace of 300 kg capacity was used, to melt material shown in Table 2 below.

TABLE 2

| Material | Composition | Blending (percentage) |
|---|---|---|
| Electrolytic nickel | 100% Ni | 30% |
| Ductile cast iron | 4.4% C-0.2% Si-0.1% Mn-Balance Fe | 30% |
| Cobalt | 100% Co | 6% |
| Pure iron | 100% Fe | 32.1% |
| Carburizer | 100% Fc | 0.7% |
| Inoculant | Fe-45% Si | 0.2% |
| Spheroidizer | Fe-7% Mg | 1.0% |

The composition, as indicated by Table 3 below, was an austenitic cast iron containing 2.0% carbon, 0.15% silicon, 0.03% manganese, 30% nickel, 6% cobalt, and 0.05% magnesium, and the balance impurities. Samples were taken with a sand-casting mold for a one inch keel block. The results of measuring the various properties are shown in Table 4. In Table 4, a thermal expansion coefficient of $1.5\times10^{-6}/°$ C., tensile strength 40 Kgf/mm$^2$, elongation 22%, and Young's modulus of 12000 Kgf/mm$^2$ were obtained.

The metal mold that was thus obtained was used in a process of press forming a pre-molded CFRP body, while heating at 200° C. Since the thermal expansion coefficient of CFRP is 1.0 to $1.5\times10^{-6}/°$ C., it was possible to greatly improve the dimensional accuracy of the CFRP product by using the mold of this embodiment, which has a coefficient of thermal expansion which is close to that of the CFRP.

As described above, with the case iron of the composition of this embodiment, a low coefficient of expansion, which is close to that of Invar alloy, can be obtained, while preserving castability, machinability and mechanical properties of the same order as those of ordinary cast iron.

EMBODIMENT 2

As shown in Table 3, the total C content of the cast iron was made 2.8%, and the Si content 0.4%. Cast iron of this composition is used when improved vibration absorbing capability is sought. Specifically, by raising the total C content to 2.8%, a specific damping capacity of 17% is obtained, i.e., a vibration absorbing capability of 4 to 5 times that of ordinary cast iron. Also, the hardness is about HB 125 to 135, i.e., the material shows a softness on the same order as that of aluminum alloy. In combination with the lubricating effect due to graphite, this is useful as a jig member for coupling and gripping without scratching the opposing member. Thus it can be used as a material for semiconductor and electronic manufacturing devices requiring high precision.

As described above, a material is obtained having the ability to absorb vibration about 4 to 5 times that of ordinary cast iron (FC 30 material), and of softness on the order of that of aluminum alloy.

EMBODIMENT 3

As shown in Table 3, the carbon content of the cast iron was set to the low value of 1.20%. The other constituents were practically the same as in the above embodiment. In this case, there was a trace of graphite crystallization. As shown in FIG. 4, workability was within the allowed range.

EMBODIMENT 4

As shown in Table 3, the silicon content was set at the high value of 0.9%. The amounts of the other constitutents were practically the same as in the above embodiments. In this case, as shown in Table 4, the thermal expansion coefficient was somewhat higher, but still within the allowed range.

EMBODIMENT 5

As shown in Table 3, the manganese content was set to 0.9%. The values of the other constitutents were practically the same as in the above embodiments. In this case, as shown in Table 4, the thermal expansion coefficient was rather higher, but still within the allowed range.

EMBODIMENT 6

As shown in Table 3, the maganese content was set to 0.7%. The values of the contents of the other constitutents were practically the same as in the above embodiments. In this case also, the thermal expansion coefficient was within the allowed range. It should be noted that, when the invention was put into practice with various contents of alloying elements, different from those of the above embodiments, but within the scope of the invention, case iron having excellent characteristics similar to the above was obtained.

COMPARATIVE EXAMPLE 1

As shown in FIG. 3, the carbon content was set to the extremely low value of 0.71%. The values of the contents of the other constitutents were practically the same as in the above embodiments. In this case, as shown in Table 4, workability, castability and ability to absorb vibration were poor.

COMPARATIVE EXAMPLE 2

As shown in Table 3, the carbon content was set to the high value of 3.6%. The other constituents were practically the same as in the above embodiments. In this case, as shown in Table 4, the elongation and strength were lowered, and a large number of casting defects were produced.

COMPARATIVE EXAMPLE 3

As show in Table 3, the silicon content was set to the high value of 1.2%. The other constituents were practically the same as in the above embodiments. In this case, as shown in Table 4, the thermal expansion coefficient was too high.

COMPARATIVE EXAMPLE 4

As shown in Table 3, the nickel content was set to the low value of 28.0%. The other constituents were practically the same as in the above embodiments. In this case, as shown in Table 4, the thermal expansion coefficient was high

COMPARATIVE EXAMPLE 5

As shown in Table 3, the nickel content was set to the high value of 37.0%. The other constitutents were practically the same as in the above embodiments. In this case, as shown in Table 4, the thermal expansion coefficient was high.

COMPARATIVE EXAMPLE 6

As shown in Table 3, the cobalt content was set to the low value of 3.5%. The contents of the other constituents were practically the same as in the above embodiments. In this case, as shown in Table 4, the thermal expansion coefficient was high.

COMPARATIVE EXAMPLE 7

As shown in Table 3, the cobalt content was set to the high value of 8.2%. The other constituents were approximately as in the above embodiments. In this case, as shown in Table 4, the thermal expansion coefficient was high.

COMPARATIVE EXAMPLE 8

As shown in FIG. 3, the total nickel and cobalt content was set to the high value of 42.5%. The other constitutents were practically as in the above embodiments. In this case, as shown in Table 4, the thermal expansion coefficient was high.

TABLE 1

| Number | Alloy name | Chemical constituents (weight %) C | Si | Mn | Ni | Co | Fe | Thermal expansion coefficient (0~200° C.) × $10^{-6}$/°C. |
|---|---|---|---|---|---|---|---|---|
| 1 | Invar | — | — | — | 34~36 | | Balance | 1.5 |
| 2 | Super-invar | — | — | — | 30~33 | 4~6 | Balance | 0.5 |
| 3 | Ni-resist D-5 (ASTM A439) | ≦2.40 | 1.0~2.80 | ≦1.0 | 34.0~36.0 | — | Balance | 5 |
| 4 | Novinite cast iron (Early Japanese Patent Publication No. Sho. 60-51547) | 0.8~3.0 | 1.0~3.0 | 0.4~2.0 | 30~33 | 4~6 | Balance | 4 |
| 5 | Cast iron according to the prior application of the present applicants (Early Japanese Patent Publication Sho. 62-268249) | ≦1.0 | ≦1.5 | ≦1.5 | 32~39.5 | 1.0~4.0 | Balance | 2 |

TABLE 3

| | Main Constituents (%) C | Si | Mn | Ni | Co | Mg |
|---|---|---|---|---|---|---|
| Embodiment 1 | 2.0 | 0.15 | 0.03 | 30.0 | 6.0 | 0.050 |
| Embodiment 2 | 2.8 | 0.4 | 0.2 | 29.5 | 6.0 | — |
| Embodiment 3 | 1.20 | 0.56 | 0.25 | 31.0 | 5.5 | 0.047 |
| Embodiment 4 | 2.30 | 0.9 | 0.30 | 31.0 | 5.5 | 0.052 |
| Embodiment 5 | 2.32 | 0.56 | 0.9 | 30.5 | 6.0 | 0.050 |
| Embodiment 6 | 2.33 | 0.55 | 0.7 | 29.0 | 7.0 | 0.050 |
| Comparative Example 1 | 0.71 | 0.60 | 0.30 | 29.5 | 6.0 | 0.050 |
| Comparative Example 2 | 3.6 | 0.8 | 0.30 | 29.5 | 6.5 | 0.050 |
| Comparative Example 3 | 2.31 | 1.2 | 0.31 | 31.0 | 6.0 | 0.048 |
| Comparative Example 4 | 2.32 | 0.56 | 0.30 | 28.0 | 4.5 | 0.050 |
| Comparative Example 5 | 2.32 | 0.50 | 0.30 | 37.0 | 6.5 | 0.062 |
| Comparative Example 6 | 2.33 | 0.52 | 0.30 | 32.0 | 3.5 | 0.045 |
| Comparative Example 7 | 2.33 | 0.54 | 0.25 | 30.0 | 8.2 | 0.048 |
| Comparative Example 8 | 2.33 | 0.52 | 0.32 | 34.5 | 8.0 | 0.060 |

TABLE 4

| | Properties: Thermal coefficient expansion (0~200° C.) (/°C.) | Tensile strength (Kgf/mm²) | Yield strength (Kgf/mm²) | Elongation (%) | Young's modulus (Kgf/mm²) | Hardness (HB) | Castability | Machinability | Ability to absorb vibration |
|---|---|---|---|---|---|---|---|---|---|
| Embodiment 1 | $1.5 \times 10^{-6}$ | 40.0 | 32.5 | 22 | $12 \times 10^3$ | 160 | good | good | good |
| Embodiment 2 | $2.1 \times 10^{-6}$ | 39.0 | 28.5 | 14 | $9.0 \times 10^3$ | 130 | good | good | particularly good |
| Embodiment 3 | $2.4 \times 10^{-6}$ | 58.5 | 55.0 | 16 | $16 \times 10^3$ | 212 | average | average | average |
| Embodiment 4 | $2.9 \times 10^{-6}$ | 43.0 | 37.5 | 20 | $10 \times 10^3$ | 196 | good | good | good |
| Embodiment 5 | $3.0 \times 10^{-6}$ | 50.0 | 39.5 | 17 | $10.2 \times 10^3$ | 218 | average | average | average |
| Embodiment 6 | $2.6 \times 10^{-6}$ | 44.5 | 38.0 | 20 | $10.5 \times 10^3$ | 224 | good | average | good |
| Comparative | $2.6 \times 10^{-6}$ | 60.0 | 57.0 | 18 | $17 \times 10^3$ | 202 | poor | poor | poor |

TABLE 4-continued

| | Properties | | | | | | | | |
|---|---|---|---|---|---|---|---|---|---|
| | Thermal coefficient expansion (0~200° C.) (/°C.) | Tensile strength (Kgf/mm²) | Yield strength (Kgf/mm²) | Elongation (%) | Young's modulus (Kgf/mm²) | Hardness (HB) | Castability | Machinability | Ability to absorb vibration |
| example 1 | | | | | | | | | |
| Comparative example 2 | $2.5 \times 10^{-6}$ | 15.3 | 12.0 | 0 | $6.2 \times 10^{3}$ | 140 | poor | good | good |
| Comparative example 3 | $3.0 \times 10^{-6}$ | 40.2 | 33.0 | 18 | $9.5 \times 10^{3}$ | 222 | good | poor | good |
| Comparative example 4 | $4.1 \times 10^{-6}$ | 40.5 | 21.0 | 21 | $10.6 \times 10^{3}$ | 162 | good | good | good |
| Comparative example 5 | $4.5 \times 10^{-6}$ | 44.5 | 35.0 | 20 | $10 \times 10^{3}$ | 202 | good | good | average |
| Comparative example 6 | $5.0 \times 10^{-6}$ | 40.0 | 19.5 | 21 | $10.5 \times 10^{3}$ | 162 | good | good | good |
| Comparative example 7 | $6.0 \times 10^{-6}$ | 45.5 | 40.0 | 21 | $12 \times 10^{3}$ | 222 | good | good | average |
| Comparative example 8 | $5.2 \times 10^{-6}$ | 43.0 | 21.0 | 23 | $10.4 \times 10^{3}$ | 152 | good | good | average |

As described above, with the cast iron of the constitutents according to this invention, a low thermal expansion characteristic of 1.5 to $3.0 \times 10^{-6}$/° C. can be obtained, while castability and machinability on the same order as that of ordinary cast iron can be obtained. Also, if required, the vibration absorbing capability can be raised to 4 to 5 times that of ordinary cast iron, and softness can be obtained on the same order as that of aluminum alloy.

The foregoing description and examples have been set forth merely to illustrate the invention and are not intended to be limiting. Since modifications of the described embodiments incorporating the spirit and substance of the invention may occur to persons skilled in the art, the scope of the invention should be limited solely with reference to the appended claims and equivalents.

What is claimed is:

1. A substantially nonporous cast iron having a graphite structure in an austenitic iron matrix and consisting essentially of , in weight %, at least about 1.0% and not more than about 3.5% of carbon, not more than about 1.0% of silicon, at least about 29% and not more than about 34% of nickel, at least about 4% and not more than about 8% of cobalt, and the balance substantially all iron.

2. A cast iron according to claim 1, further including not more than about 1.0% of manganese.

3. A cast iron according to claim 1, further including not more than about 0.1% of magnesium.

4. A cast iron according to claim 2, further including not more than about 0.1% of magnesium.

5. A cast iron according to claim 1, wherein carbon is present in an amount of from about 2.0% to 3.0%.

6. A cast iron according to claim 1, wherein silicon is present in an amount of from about 0.3% to 0.5%.

7. A cast iron according to claim 1, wherein manganese is present in an amount of not more than about 0.5%.

8. A cast iron according to claim 1, wherein the cast iron has a thermal expansion coefficient at 0°-200° C. of not more than about $3 \times 10^{-6}$/° C.

9. A mold element for forming a carbon fiber reinforced plastic antenna reflector, comprising a generally disk-shaped mold element made of a cast iron composition having a thermal expansion coefficient of about $1.5 \times 10^{-6}$/° C. at 0°-200° C. and defined according to claim 1.

10. A cast iron according to claim 1, wherein silicon is present in an amount of about 0.3% or more.

* * * * *